United States Patent [19]

Wilhelm

[11] 4,080,767

[45] Mar. 28, 1978

[54] BUILDING WALL WITH APPLIED FINISHING SURFACE DESIGN

[76] Inventor: William D. Wilhelm, 533 San Juan, St. Charles, Mo. 63301

[21] Appl. No.: 684,733

[22] Filed: May 10, 1976

[51] Int. Cl.[2] ..... E04C 1/00

[52] U.S. Cl. ..... 52/314; 52/444; 52/453; 52/744

[58] Field of Search ..... 52/444, 453, 314, 316, 52/311, 555, 558, 741, 443, 446, 515, 603, 605, 596, 744

[56] References Cited

U.S. PATENT DOCUMENTS

| | | | |
|---|---|---|---|
| 1,706,661 | 3/1929 | Greenebaum | 52/314 |
| 1,796,269 | 3/1931 | Rose | 52/515 |
| 2,114,450 | 4/1938 | MacLean | 52/314 |
| 2,199,112 | 4/1940 | O'Leary | 52/314 |
| 2,245,047 | 6/1941 | Odell | 52/314 |
| 2,245,468 | 6/1941 | Dussol | 52/515 |
| 2,311,590 | 2/1943 | Feder | 52/314 |
| 2,359,845 | 10/1944 | Harshberger | 52/515 |
| 2,482,556 | 9/1949 | Petras | 52/314 |

*Primary Examiner*—John E. Murtagh

*Attorney, Agent, or Firm*—Gravely, Lieder & Woodruff

[57] ABSTRACT

A building wall erected from blocks presenting one or more surfaces formed with a matrix of grooves generally horizontally and vertically related, and an overlay veneer or applied surface coating adapted to be impressed or indented with appropriate tools in a manner to produce a wide variety of designs by selection of different combination of the grooves in the matrix. A method of variously decorating one or more building wall surfaces or sides of walls with the guidance of a matrix of grooves and an overlay coating adapted to be impressed or indented in cooperation with preselected grooves of the matrix.

9 Claims, 9 Drawing Figures

FIG. 1
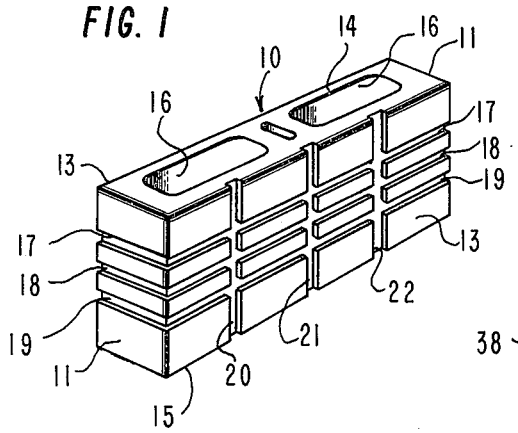
FIG. 3
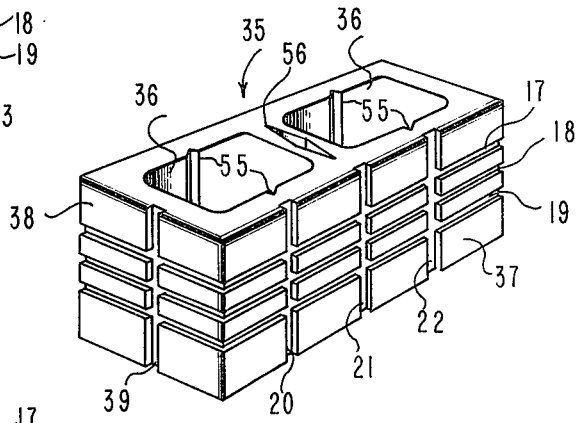
FIG. 2
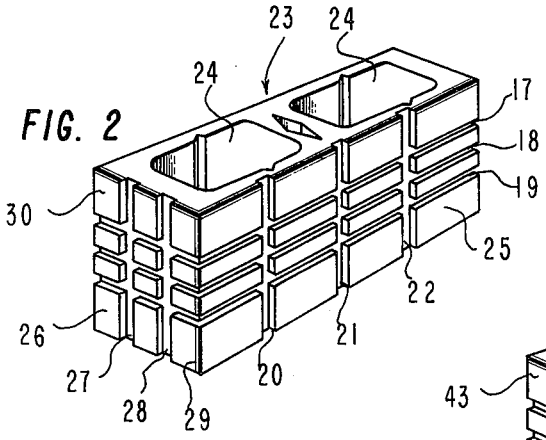
FIG. 5
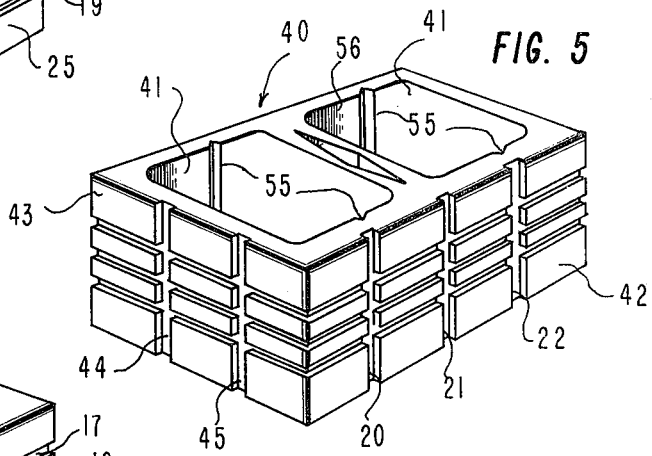
FIG. 4
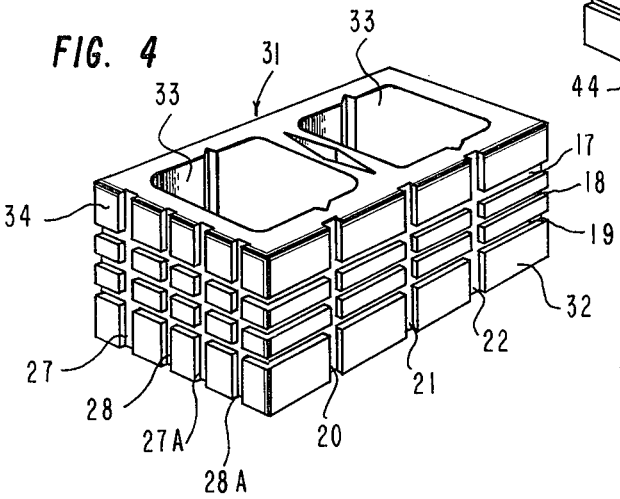
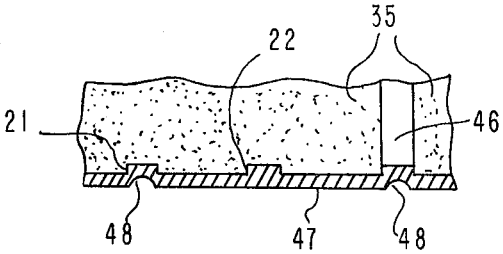
FIG. 9

BUILDING WALL WITH APPLIED FINISHING SURFACE DESIGN

BRIEF SUMMARY OF THE INVENTION

This invention relates to a building wall adapted to be erected with blocks that are pregrooved on the inner and outer faces and ends to form a matrix of grooves to receive a surface overcoat into which a variety of designs can be impressed or indented, and it also relates to a method of developing many designs in a surface coating for one or more surfaces of walls using grooved surfaces in underlying blocks.

The prior art is known to have a concrete or masonry block wall capable of being manufactured with surface designs. However, normally the wall blocks do not come with any pattern of grooves so that the grooving has to occur after the blocks are laid up in a wall. A special situation is known where concrete masonry blocks formed in apparatus of U.S. Pat. No. 3,381,345 of Charles L. Williams offer limited possibilities for surface decoration, as these blocks are sized and shaped only to simulate the appearance of standard brick wall lay ups. It is also known in the art that designers and architects like to call for esthetic characteristics in a lay up of blocks in a wall such that they form designs in or on the wall surface or designs with raised surfaces on two or more blocks which is repeated throughout the wall. Generally it requires several blocks to be matched to complete one design which is repetitive. These prior art examples are expensive and require many different blocks to complete a wall design. Great care is required to properly match blocks which takes time and increases costs and requires large inventories of blocks for each design. Each block design also requires its own mold parts, so an inventory of molds is required.

It is also known that an architect or designer will seldom use a design more than one time, and it is very unlikely that his competitors will use the same design or pattern. Therefore, special designed masonry units are very costly.

The objects of the present invention are to provide a modular matrix of grooves carried as a standard throughout many different sizes of molded concrete blocks so that a wall lay up with any one block size or even several sizes of blocks can have the matrix of grooves match up to form the basis for receiving a coating of suitable material capable of being impressed or indented in a variety of designs drawn out of the underlying matrix of grooves, to provide a coating for the surfaces of a building wall that can receive a design while it is in a workable state and hold a design thereafter, where the design or designs may be composed of lines selected from corresponding underlying grooves in the wall blocks, to provide a method of achieving ornamental designs in a masonry wall or walls with the use of simple well known jointer tools, and to provide architects with a generally common system of grooved blocks to quickly and economically choose different designs and form selected designs in one or all of the walls of a building or vary the designs for each wall of a building after the wall is laid up.

The invention is embodied in a decorative building wall, whether an internal partitioning wall or an exterior wall, which comprises in combination a plurality of blocks laid up in cooperative abutting relation in courses to form a wall surface, a plurality of grooves formed in each block with the grooves providing a matrix in the lay up of the wall, and a layer of a settable material covering the grooved matrix in which is impressed a pattern of grooves, following one or more of the grooves in the matrix whereby the surface of the wall formed by the blocks takes on a decorative appearance.

The invention is further embodied in a method of decorating the surface of an otherwise raw building wall, whether an interior partition or an exterior wall, composed of blocks arranged in abutting relation in courses to form a wall surface, which method consists in grooving the surfaces of the individual blocks, laying the blocks in abutment in the wall with the grooves exposed in cooperative adjacency to form a matrix of grooves and joints, covering the matrix with a coating of settable material, and impressing the coating material prior to setting with a decorative pattern of visible grooves which overlie one or more of the grooves in the covered matrix.

BRIEF DESCRIPTION OF THE DRAWINGS

This invention is embodied in certain forms of molded blocks with a selection of grooves forming a matrix in a wall lay up, and is represented in the accompanying drawings, wherein:

FIG. 1 is a perspective view of a typical block having a 4 inch thickness carrying a pattern of side and end grooves, the pattern on the visible end being duplicated in the hidden surfaces when necessary;

FIG. 2 is a perspective view of a typical 6 inch thick block carrying a pattern of grooves in the visible end and side, it being sometimes necessary to form similar grooves in the hidden surfaces;

FIG. 3 is a perspective view of a typical 8 inch thick block formed with a pattern of grooves in the end and sides, and when necessary with grooves in the hidden surfaces;

FIG. 4 is a perspective view of a typical 10 inch block having the pattern of grooves like those in the block of FIG. 2, and when necessary in the hidden surfaces;

FIG. 5 is a perspective view of a 12 inch thick block having the grooves compatible with those of the other blocks, and when necessary in the hidden surfaces;

FIG. 9 is a fragmentary sectional view taken along line 9—9 in FIG. 6 to show a typical detail of the coating applied to the surfaces of blocks of FIG. 3.

DETAILED DESCRIPTION OF THE EMBODIMENTS

Figure 6:
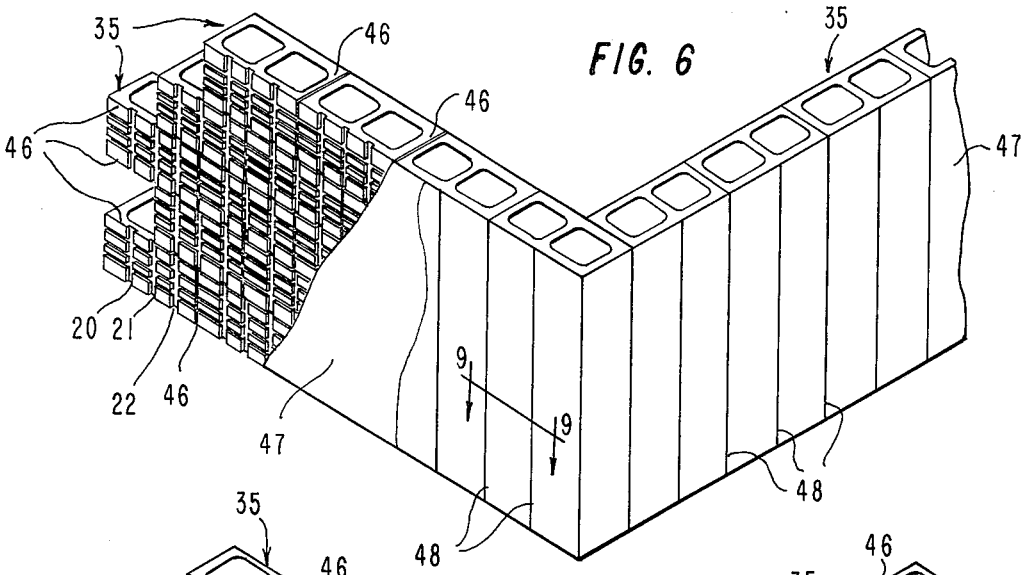
FIGS. 6, 7 and 8 are perspective views of fragmentary wall lay ups using 8 inch thick blocks of FIG. 3, and showing the varieties of designs that can be impressed or indented in the coating applied to the wall.

The molded concrete block 10 in FIG. 1 has a generally rectangular body with opposite vertical ends 11, opposite vertical faces 13 and top and bottom surfaces 14 and 15. The body is formed with cored openings 16 to reduce weight. The visible end 11 and face 13 are formed with aligned grooves 17, 18 and 19 and the face 13 is formed with parallel vertical grooves 20, 21 and 22. It is preferred to form block 10 with certain dimensions that have become standard in the concrete block industry. Therefore, block 10 is formed to be about 4 inches wide, about 8 inches high, and about 16 inches long. These dimension are then used to determine where to place the several horizontal grooves and the vertical grooves.

For example, if the block 10 is to be compatible with the standard brick, which is 2¼ inches, by 3⅝ inches, by 7⅝ inches, the groove 18 is located to divide the 8 inch height equally. The grooves 17 and 19 are then located in spaced relation from groove 18 to divide the 8 inch height into three equal parts. The vertical set of grooves 20, 21 and 22 (FIG. 1) are located to divide the length of 16 inches into quarters, or divisions of about 4 inches each. Obviously due allowance needs to be made for mortar joints, but for the simplicity of this disclosure the foregoing general arrangement of the horizontal set of grooves 17, 18, 19 in the ends as well as the sides will be followed throughout the other blocks.

If a wall is laid up using only the blocks of FIG. 1, the running bond between the first and second courses (FIG. 9) would be on a one quarter bond in which one space between the vertical groove 22 and the nearest end 11 would lap on the adjacent underlying block. This bond pattern is dictated by the way the blocks in a corner are overlapped. It is clear that the grooves 17, 18 and 19 and the grooves 20, 21 and 22 form a matrix of horizontal and vertical grooves out of which can be selected an infinite variety of designs from a design of a standard brick lay up to wide horizontal bands or vertical column effects.

Having now visualized the possible designs that can be selected, it is the next step of this invention to mask the entire matrix of grooves in a complete wall with a settable coating. The coating can be made up from a cement base with fine sand or crushed limestone, a bonding agent such as ACRYL 60 by Standard Dry Wall of Florida, and suitable waterproofing agents. Coloring can be mixed into the coating, or paint can be applied later. The coating can be laid on in any approved manner and has a thickness which may vary from about one-sixteenth to about three-sixteenth inch so as to completely cover all grooves and joints. It is preferred to rely upon the thinner coating for ease of tooling and following the underlying grooves. Before the coating sets up or hardens, the wall is tooled with a mason's jointer tool in the vertical and horizontal groove locations previously chosen. As the tooling progresses the selected design will emerge and give the wall a pleasing appearance. In this manner, a raw concrete block wall usually having the blocks boldly outlined in rectangles of 8 inches by 16 inches can be transformed into one that is made to look like a brick wall without actually having an underlying brick wall. Examples of generally standard designs for a raw uncoated wall are Coursed Ashlar, Vertical Stacking, Horizontal Stacking, Square Stacking, Basket Weave, and Patterned Ashlar. A coated wall with an underlying groove matrix is unique as patterns can be brought out in which the coating is indented with the pointing tool to build the selected design. It is important to allow the mortar used to hold the blocks in the wall to set up and become rigid so that the impressing of the design will not disturb the lay up. In creating a design, the tooling must progress right along with the application of the coating so the grooves can be followed.

In FIG. 2 there is shown a 6 inch wide block 23 formed with cored out openings 24 to reduce weight. This block is formed with a series of vertical and horizontal grooves on its 16 inch long face 25 which exactly duplicate the grooves in the face 13 of block 10, and these grooves have similar reference numbers. The pattern of grooves in the visible end 26 includes the continuation of the three horizontal grooves 17, 18 and 19 from face 25. The end 26 which is 6 inches wide is formed with a pair of vertical grooves 27 and 28 which are spaced from the corners of the block body so that groove 27 is spaced from the farthest corner 29 a distance equal to about the width of block 10. The other groove 28 is spaced a similar distance from the farthest corner 30 so as to maintain modular compatibility with block 10.

In like manner, the block 31 of FIG. 4 is formed on its face 32 with a pattern of horizontal grooves 17, 18 and 10 described before, and with a pattern of vertical grooves 20, 21 and 22 as before noted. The block 31 is cored out at 33 to reduce weight. Carrying out the modular pattern of the vertical grooves 27 and 28 in the end of block 23, it is now evident to have four such grooves in the end of block 31 and these are designated 27, 28, 27A and 28A.

The block 35 of FIG. 3 is the most widely used size, being about 8 inches wide and high and about 16 inches long. Cores 36 are formed to reduce weight. The pattern of grooves in the side face 37 are the same as for block 10 and are so designated by similar reference numbers. The end 38 is about 8 inches wide and, therefore, lends itself to be divided by a single vertical groove 39 into about 4 inch halves.

The remaining block 40 shown in FIG. 5 is 12 inches wide and is formed with cores 41 to reduce weight. Again, the side face 42 is formed with the now familar pattern of horizontal grooves 17, 18 and 19, and with the equally spaced vertical grooves 20, 21 and 22. The grooves in the end 43 include vertical grooves 44 and 45 which are spaced to divide the end into about 4 inch equal divisions. The spacing of grooves 44 and 45 is about the same as for the spacing of grooves 20, 21 and 22 in the side to maintain the modular dimensions.

Turning now to FIG. 6, it can be seen that the wall lay up is composed of the blocks seen in FIG. 3, and the wall includes a corner and two wall runs leading away from the corner. This perspective view illustrates the steps of the method of transforming the raw surface of a block wall into a wall having a pleasing appearance. The raw wall lay up of blocks 35 can be seen at the left so that the matrix of grooves 17, 18, 19, 20, 21 and 22 match up in a running bond with mortar joints 46 outlining the respective blocks. After the blocks 35 are laid up, a parget or coating 47 is applied over the blocks 35 so the several grooves are covered and the coating penetrates the grooves. FIG. 9 is a fragmentary section to show the coating 47 covering grooves 21, 22 and a mortar joint 46 between adjacent blocks 35. The grooves and joint 46 are raked or rectangular so the coating 47 will penetrate the same and preserve the integrity of the coating layer when tooling in the design. One example is to form the groove about ¾ inch wide and 3/16 inch deep, and to apply the coating 47 to a depth of from about 1/16 inch to about 3/16 inch. The coating extends to the left from the corner and the area covered is about as large as is desirable for the purpose of allowing the worker to pick up the desired underlying grooves from those exposed ahead (to the left) of the application of the coating. The wall area to the right of the corner has a complete columnar design impressed therein by indentations 48.

Figure 7:
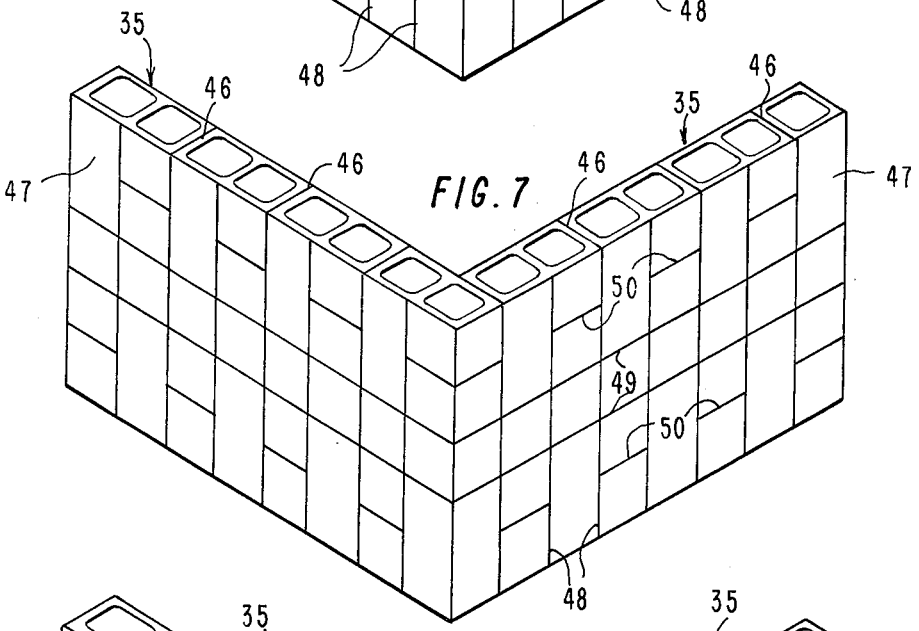
Figure 8:
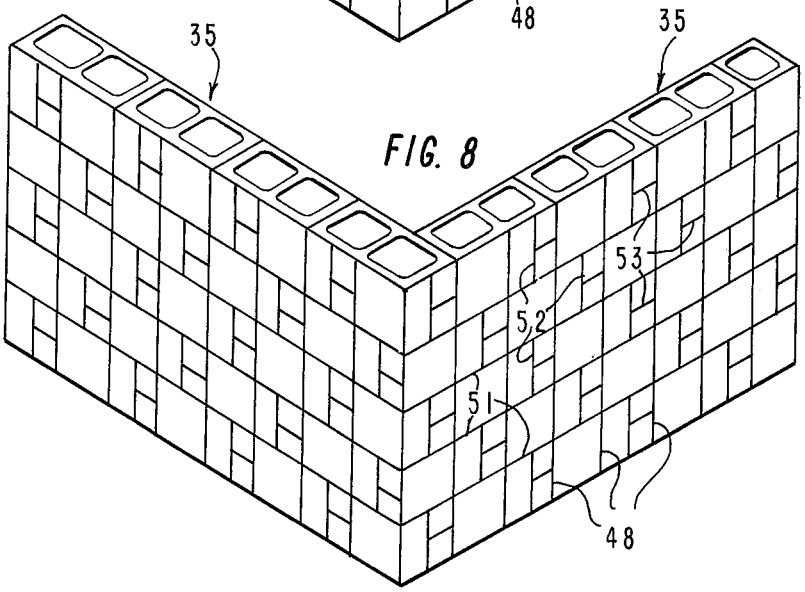

The views of FIGS. 7 and 8 provide other examples of designs impressed in the coating 47 applied over a wall composed of blocks 35 having mortar joints 46. In the design of FIG. 7 the vertical indentations 48 are now blended into adjacent horizontal impressions 49 and by broken or discontinuous horizontals 50. The coating 47 is laid on and the design follows up closely behind the progressive laying on the coating. The view of FIG. 8 shows still another wall design which is a variant of the design of FIG. 7 but having smaller areas defined by the indentations. Thus the vertical indentations 48 are further blended into evenly spaced horizontal indentations 51, and by a combination of short vertical indentations 52 and cooperating horizontal indentations 53.

The blocks seen in FIGS. 1 to 5 can be commercially produced in known manner by providing the forming molds with vertical ribs or inserts which form the grooves 20, 21, 22, 27, 28, 27A, 28A, 39, 44 and 45 and allow the blocks to be ejected onto a conveyor. The blocks are then aligned and passed adjacent gang masonry saws or grooving discs and the respective grooves 17, 18 and 19 are formed in two passes, one for the sides and one for the ends.

As can be seen in FIG. 3, the block 35 is formed in the cored passages 36 with notches 55 extending through the heighth of the block, and with a central slot 56 in the body web between cored openings 36. The notches are supplied to make it easy to break off a portion of the block body so the reduced portion will fit a need for less than a complete or whole block. The slot 56 serves the same function when a one-half block is needed. The other blocks seen in FIGS. 1, 2, 4 and 5 may be similarly provided with notches and slots but these are not thought necessary to show as it can be readily appreciated from FIG. 3.

It can now be understood that a building wall laid up with blocks of the character described, having a resulting matrix of cooperating grooves in one or both surfaces, can be coated or pargetted with a settable material and impressed or indented with any of many designs or with a combination of designs overlying and guided as to location by the underlying grooves in the blocks. The resulting wall construction with a decorative surface design different from the regular running bond mortar joint scheme can be created by the unique method of selecting a pattern of guiding grooves from the wall block groove matrix, coating the blocks, and tooling the selected design into the coating. Where the blocks are used to form interior walls between adjacent spaces or areas, the unique method can be used to great advantage to impress a different design on the opposite surface of the common wall. Since it has been pointed out before that the blocks can be grooved on opposite ends or sides, it follows that a common wall, such as a partition separating adjoining spaces, can be made up of blocks having the same matrix of grooves on the opposite exposed faces and the decorative designs of FIGS. 6, 7 or 8 may be impressed in the opposite walls so that the monotony of repetitive designs is easily avoided.

What is claimed is:

1. A building wall comprising, in combination, a plurality of individual blocks laid up in abutment and in overlying courses in a wall, said individual blocks having generally rectangular bodies separated by mortar joints and presenting individual faces in the surface of the wall, each of said individual block faces being formed with horizontally and vertically directed grooves which cooperate in the wall layup to provide with said mortar joints a matrix of grooves extending throughout the wall, and a layer of material forming a coating applied over said matrix of grooves to fully cover the same, said coating being indented to define a pattern of grooves in said coating material which is exposed to view and which follows a predetermined selection of grooves in said covered underlying matrix of grooves.

2. The building wall of claim 1 wherein said vertically directed grooves are spaced apart distances to substantially equally subdivide the horizontal dimension of each individual block into a plurality of divisions whch extend throughout the vertical dimension of each individual block.

3. The building wall of claim 1 wherein said certain of said horizontally directed grooves are spaced apart distances subdividing the vertical dimension of each individual block into substantially equal divisions.

4. The building wall of claim 1 wherein said grooves in said individual blocks are cooperatively arranged with multiple horizontal grooves and with multiple vertical grooves, said grooves of said individual blocks intersecting with each other and being covered by said coating material layer, said grooves serving as guides for indenting said coating material layer, whereby an indentation pattern is formed thereby.

5. A method of decorating the raw surface of a building wall composed of a plurality of blocks arranged in abutment in and between courses and normally having exposed abutment joints, said method consisting in initially grooving the raw surfaces of the blocks, laying the block in abutment in the wall with the grooves exposed in the raw surface such that the grooves and grooved abutment joints cooperate to form a matrix of grooves in the wall surface, coating the matrix of grooves and joints with a substantially uniform layer of material, and impressing grooves in the exterior surface of the coating aligned with selected underlying grooves and joints to form a decorative pattern of visible grooves.

6. The method set forth in claim 5 wherein said coating progresses along the wall covering the matrix, and impressing the decorative pattern progresses after the coating.

7. The method set forth in claim 5 wherein the decorative pattern of visible grooves extends in at least two directions.

8. The method set forth in claim 5 wherein the method is practiced in relation to the opposite sides of the wall.

9. The method set forth in claim 8 wherein the decorative pattern of visible grooves is different in the opposite sides of the wall.

* * * * *

UNITED STATES PATENT AND TRADEMARK OFFICE

CERTIFICATE OF CORRECTION

PATENT NO. : 4,080,767

DATED : March 28, 1978

INVENTOR(S) : William D. Wilhelm

It is certified that error appears in the above-identified patent and that said Letters Patent are hereby corrected as shown below:

Column 4, line 54 after "about" and before "inch" change "3/4" to "3/8"

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*